US012465114B2

(12) United States Patent
Takashima et al.

(10) Patent No.: US 12,465,114 B2
(45) Date of Patent: Nov. 11, 2025

(54) SOLE STRUCTURE AND SHOE WITH A PLURALITY OF CONCAVE AND CONVEX SHAPES

(71) Applicant: ASICS CORPORATION, Hyogo (JP)

(72) Inventors: Shingo Takashima, Hyogo (JP); Norihiko Taniguchi, Hyogo (JP); Yuya Kozuka, Hyogo (JP); Genki Hatano, Hyogo (JP); Satoru Abe, Hyogo (JP); Masanori Sakaguchi, Hyogo (JP); Hisashi Maejima, Hyogo (JP); Seiji Yano, Hyogo (JP); Takayuki Ueda, Hyogo (JP); Katsunori Yagyu, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 19 days.

(21) Appl. No.: 18/039,669

(22) PCT Filed: Dec. 16, 2020

(86) PCT No.: PCT/JP2020/046983
§ 371 (c)(1),
(2) Date: May 31, 2023

(87) PCT Pub. No.: WO2022/130538
PCT Pub. Date: Jun. 23, 2022

(65) Prior Publication Data

US 2024/0000184 A1 Jan. 4, 2024

(51) Int. Cl.
*A43B 13/14* (2006.01)
*A43B 7/144* (2022.01)

(52) U.S. Cl.
CPC ..... *A43B 13/146* (2013.01); *A43B 7/144* (2013.01); *A43B 13/145* (2013.01)

(58) Field of Classification Search
CPC ..... A43B 13/12; A43B 13/14; A43B 13/143; A43B 13/145; A43B 13/146;
(Continued)

(56) References Cited

U.S. PATENT DOCUMENTS 3,936,956 A 2/1976 Famolare, Jr.
4,096,649 A * 6/1978 Saurwein ..... A43B 13/223 36/32 R
(Continued)

FOREIGN PATENT DOCUMENTS

CN 101400272 A 4/2009
CN 209498738 U 10/2019
(Continued)

OTHER PUBLICATIONS

Supplementary European Search Report issued Dec. 1, 2023 in corresponding European Application No. 20965926.7.
(Continued)

*Primary Examiner* — F Griffin Hall
(74) *Attorney, Agent, or Firm* — Global IP Counselors, LLP

(57) ABSTRACT

A sole structure of a shoe includes a rearfoot-side concave-shaped portion including a vertex region in a bottom surface of the sole in a rearfoot region. The vertex region is positioned at a highest position within the bottom surface of the sole in the rearfoot region and configured to be positioned at a position corresponding to a center of a heel of a wearer such that center of pressure of the wearer overlaps with the center of the heel.

20 Claims, 6 Drawing Sheets

(58) Field of Classification Search
CPC ..... A43B 13/148; A43B 7/144; A43C 15/02; A43C 15/04; A43C 15/16; A43C 15/161; A43C 15/162; A43C 15/164; A43C 15/165; A43C 15/167; A43C 15/168
See application file for complete search history.

(56) References Cited

U.S. PATENT DOCUMENTS

| | | | | |
|---|---|---|---|---|
| 4,494,320 | A * | 1/1985 | Davis | A43B 13/223 36/103 |
| 8,533,977 | B2 | 9/2013 | Hide et al. | |
| 8,863,407 | B2 | 10/2014 | Nishiwaki et al. | |
| 10,932,518 | B2 | 3/2021 | Matsui et al. | |
| 11,291,271 | B2 * | 4/2022 | Jones | A43B 3/0078 |
| 2008/0052965 | A1 | 3/2008 | Sato | |
| 2011/0179672 | A1 | 7/2011 | Cheng | |
| 2011/0185590 | A1 | 8/2011 | Nishiwaki et al. | |
| 2011/0225852 | A1 * | 9/2011 | Mahoney | A43B 13/146 36/30 R |
| 2011/0277351 | A1 | 11/2011 | Scoledes | |
| 2016/0037858 | A1 | 2/2016 | Foxen | |
| 2020/0390189 | A1 * | 12/2020 | Campos, II | A43B 13/122 |

FOREIGN PATENT DOCUMENTS

| | | | |
|---|---|---|---|
| JP | 50150543 | A | 12/1975 |
| JP | S6074605 | U | 5/1985 |
| JP | 108182505 | A | 7/1996 |
| JP | 2007330469 | A | 12/2007 |
| JP | 2008093016 | A | 4/2008 |
| JP | 2013046667 | A | 3/2013 |
| JP | 2019162357 | A | 9/2019 |
| KR | 19990041727 | A | 6/1999 |
| WO | 2010038266 | A1 | 4/2010 |

OTHER PUBLICATIONS

International Search Report issued Feb. 2, 2021 in corresponding International Application No. PCT/JP2020/046983.

International Preliminary Report on Patenability issued Feb. 2, 2021 in corresponding International Application No. PCT/JP2020/046983.

First Office Action received for Chinese Patent Application Serial No. 202080107737.7, mailed on Mar. 28, 2025, 18 pages. (Including English Translation).

* cited by examiner

SOLE STRUCTURE AND SHOE WITH A PLURALITY OF CONCAVE AND CONVEX SHAPES

CROSS-REFERENCE TO RELATED APPLICATION

This application is a U.S. National Stage application of PCT/JP2020/046983, filed Dec. 16, 2020, the contents of which are hereby incorporated by reference.

BACKGROUND

Technical Field

The present disclosure relates to a sole structure and a shoe.

BACKGROUND ART

Various sole structures have been conventionally proposed to improve ease of wearing for wearers (Japanese Unexamined Patent Application Publication No. 2019-162357 and WO2010/038266, for example).

SUMMARY

When a wearer is working while standing or is singing, the wearer needs to maintain an upright posture in order to fully demonstrate his or her ability. In order for the wearer to stably maintain a standing posture, it is desirable to overlap the center of pressure (COP) of the wearer with the center of the heel of the wearer. However, previously, no sole structure has been developed from this perspective.

A purpose of the present disclosure is to provide a sole structure that enables the wearer to stably maintain a standing posture.

To solve the problem above, one embodiment of the present invention relates to a sole structure of a shoe, in which a rearfoot-side concave-shaped portion including a vertex region is formed in a bottom surface rearfoot region of the sole, and the vertex region is positioned at the highest position within the sole bottom surface in the bottom surface rearfoot region and also positioned at a position corresponding to the center of a heel of a wearer such that the center of pressure of the wearer overlaps with the center of the heel.

DETAILED DESCRIPTION

Definitions of terms used in this specification will be described first. In this specification, front and rear directions (longitudinal directions), width directions, and vertical directions can be used as terms indicating directions. These terms indicate directions viewed from a viewpoint of a wearer wearing a shoe placed on a flat surface. Accordingly, the front direction means a direction toward the toe side, and the rear direction means a direction toward the heel side. Also, a medial side and a lateral side of a foot can be used as terms indicating directions. The medial side of a foot means the inner side of the foot in a width direction, i.e., the big toe (first toe) side of the foot, and the lateral side of the foot means the side opposite to the medial side along a width direction.

Further, in the following description, directions can be described using a three-dimensional Cartesian coordinate system. In this case, the X-axis extends from the medial side toward the lateral side of the foot, the Y-axis extends from the heel side toward the toe side, and the Z-axis extends from the bottom surface side toward the upper side.

Before a shoe according to an embodiment is described, a foot skeleton relevant to the shoe according to the embodiment will be described with reference to FIG. 1.

Figure 1:
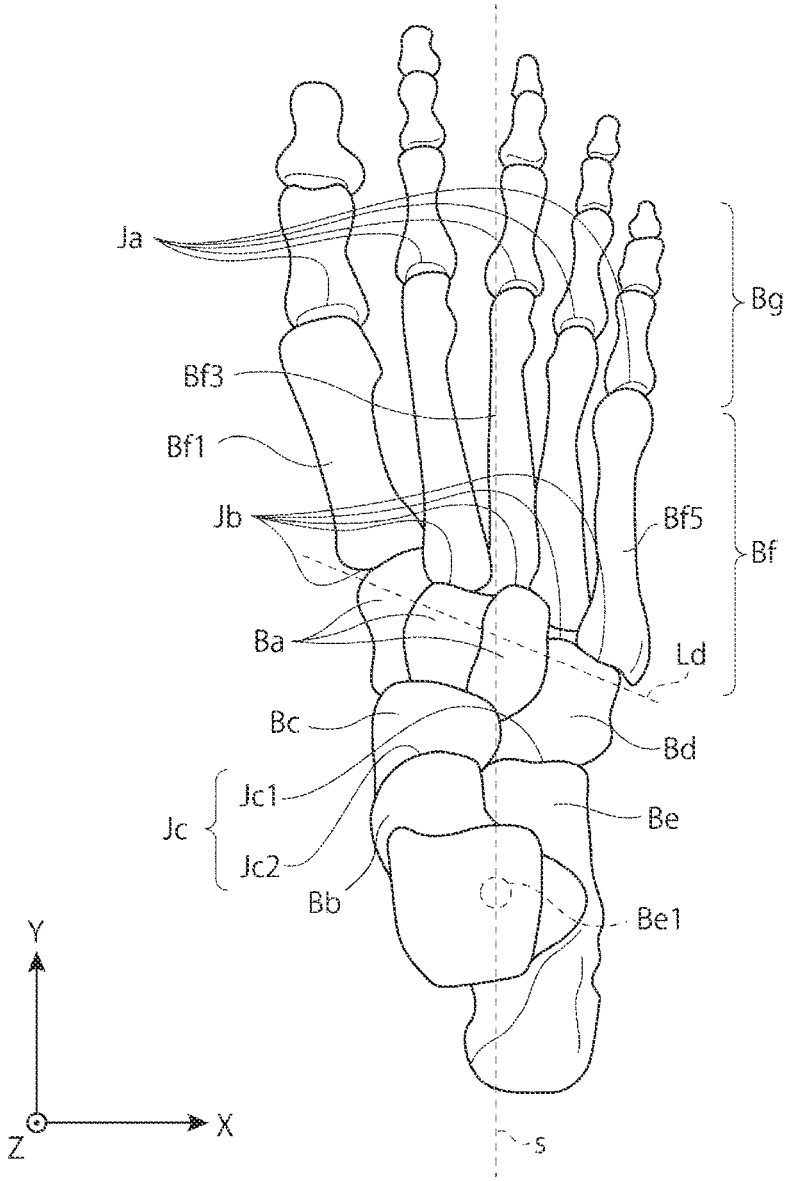
FIG. 1 is a top view of a foot skeleton.

FIG. 1 is a top view of a foot skeleton. A human foot is mainly formed by cuneiform bones Ba, a cuboid bone Bd, a navicular bone Bc, a talus Bb, a calcaneus Be, metatarsal bones Bf, and phalanges Bg. Joints of afoot include MP joints Ja. Lisfranc joints Jb, and a Chopart's joint Jc. The Chopart's joint Jc includes a calcaneocuboid joint Jc1 formed by the cuboid bone Bd and the calcaneus Be, and a talocalcaneonavicular joint Jc2 formed by the navicular bone Bc and the talus Bb. In this specification, a "forefoot portion" of a wearer means a portion positioned forward of the MP joints Ja; when it is restated with shoe length ratio, the forefoot portion means a portion between the positions of 0% and about 30% of the entire shoe length measured from the toe side. A "forefoot region" on a sole bottom surface means a region of a sole that overlaps with the forefoot portion when viewed from the top. Also, a "midfoot portion" means a portion from the MP joints Ja to the Chopart's joint Jc and corresponds, similarly, to a portion between the positions of about 30% and 80% of the entire shoe length measured from the toe side. A "midfoot region" on a sole bottom surface means a region of a sole that overlaps with the midfoot portion when viewed from the top. Also, a "rearfoot portion" means a portion positioned rearward of the Chopart's joint Jc and corresponds, similarly, to a portion between the positions of about 80% and 100% of the entire shoe length measured from the toe side. A "rearfoot region" on a sole bottom surface means a region of a sole that overlaps with the rearfoot portion when viewed from the top. In FIG. 1, a center line S indicates a center line of a shoe and extends along a middle part in a foot width direction. The center line S is assumed to be a region positioned on a straight line passing through a third metatarsal bone Bf3 and a medial process Be1 of calcaneal tuberosity of the calcaneus Be in a human body. FIG. 1 shows an area where the medial process Be1 of calcaneal tuberosity is assumed to be positioned. The area where the medial process Be1 of calcaneal tuberosity is positioned overlaps with the center of a heel of a wearer at rest. The ratios in the entire shoe length are indications and do not limit the ranges of the forefoot portion, midfoot portion, and rearfoot portion.

Figure 2:
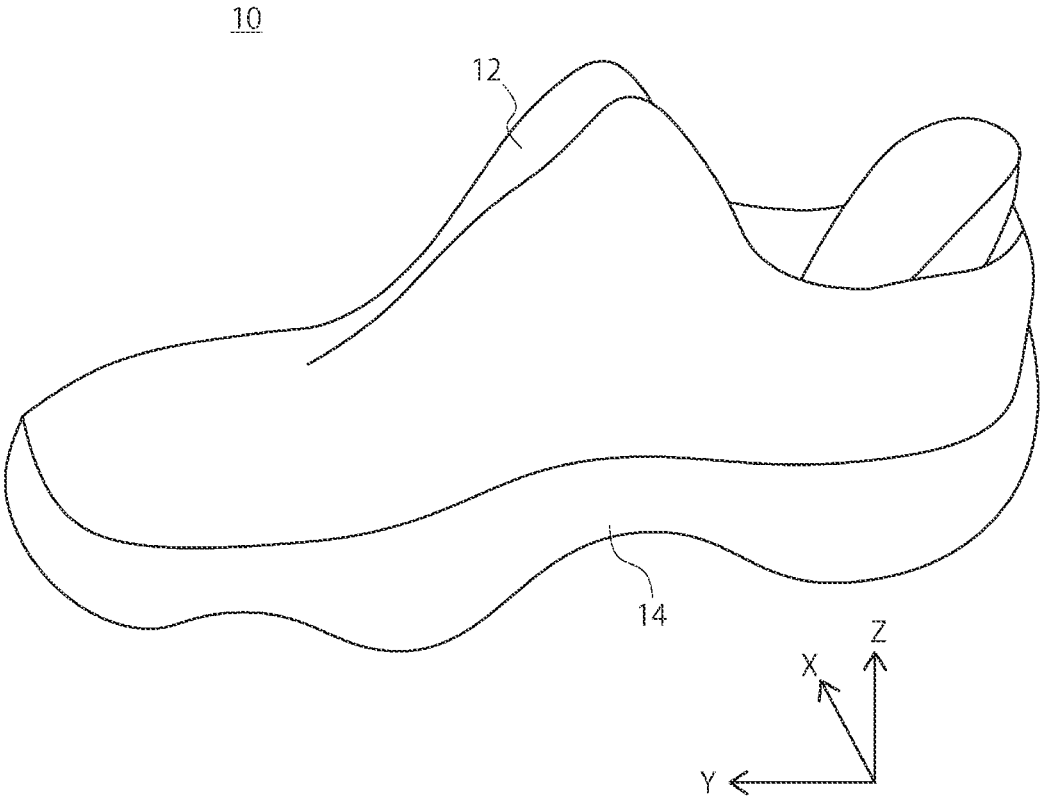
FIG. 2 is a perspective view of a shoe.

FIG. 2 is a perspective view of a shoe. As illustrated in FIG. 2, a shoe 10 includes an upper 12 and a sole 14. The upper 12 has a shape that wraps around the instep of the wearer.

The upper 12 is joined to the sole 14 along the outer circumference of the sole 14. As the upper 12, various types of uppers can be employed, such as the upper of a laced shoe of which fit is adjustable with laces, a slip-on shoe or a monosock shoe that does not include a fastening means or device such as laces, or the like.

The sole 14 includes one or both of a midsole and an outsole. Accordingly, in the following, when the sole shape and the like is referred to, the term "sole" means the entire sole 14 including the midsole and the outsole, which are considered to be integrally formed, unless otherwise explicitly specified. The sole 14 absorbs impact, and part of or the entirety of the sole 14 is formed of a soft material for absorbing impact, which can be a foam material, such as expanded EVA, urethane foam, or foamed thermoplastic elastomer, GEL, or cork, for example. The material of the midsole 16 can suitably have the Young's modulus of 10 MPa or less (when the strain is 10%) or a value measured using the ASKER Durometer Type C of 70 or less.

Figure 3:
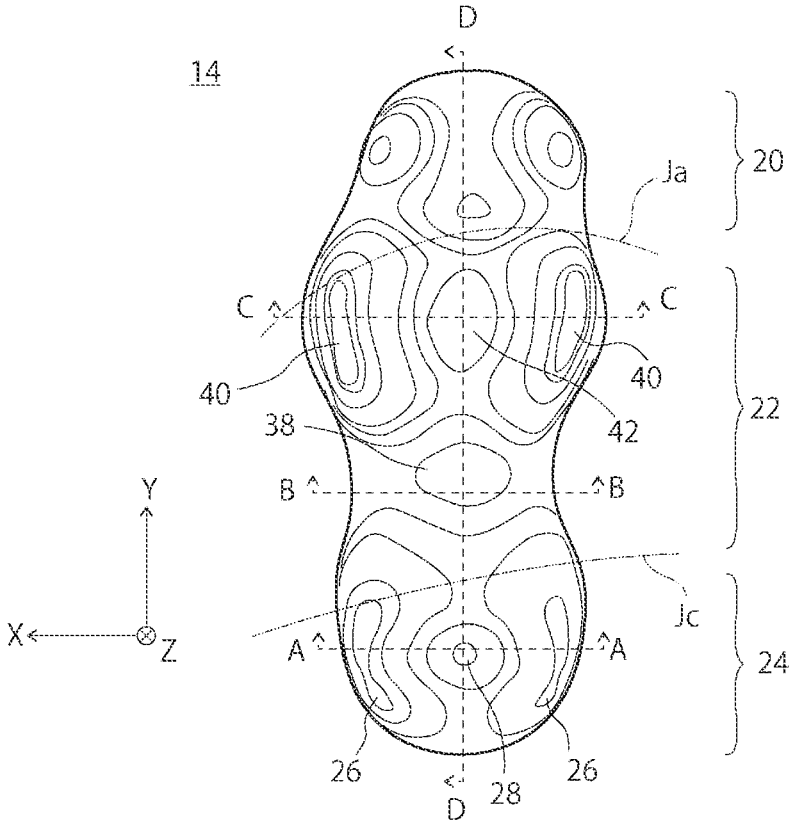
FIG. 3 is a bottom view of a sole.
Figure 5:
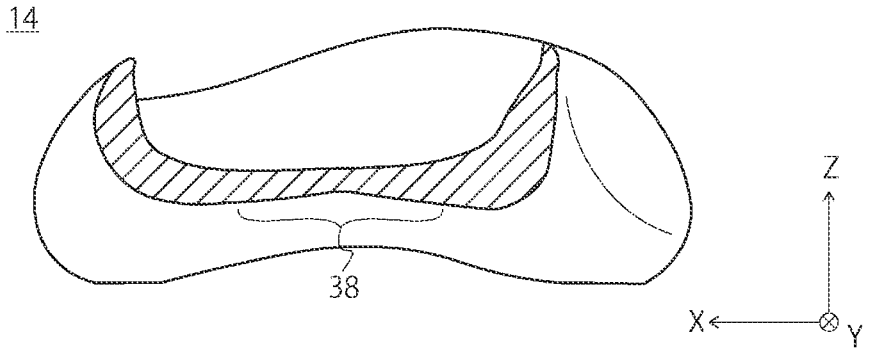
FIG. 5 is a sectional view taken along line B-B in FIG. 3.
Figure 6:
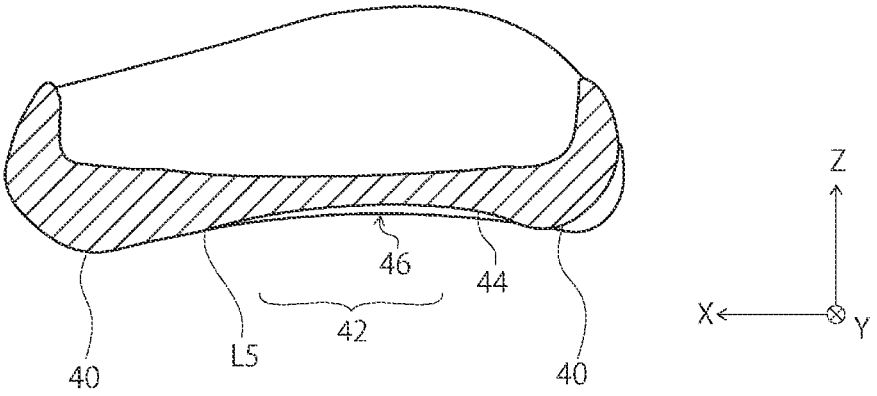
FIG. 6 is a sectional view taken along line C-C in FIG. 3.

FIG. 3 is a bottom view of the sole. Also, FIG. 4 is a sectional view taken along line A-A in FIG. 3, FIG. 5 is a sectional view taken along line B-B in FIG. 3, FIG. 6 is a sectional view taken along line C-C in FIG. 3, and FIG. 7 is a sectional view taken along line D-D in FIG. 3.

The bottom surface of the sole 14 includes a forefoot region 20 corresponding to the forefoot portion of the foot of the wearer, a midfoot region 22 corresponding to the midfoot portion of the foot of the wearer, and a rearfoot region 24 corresponding to the rearfoot portion of the foot of the wearer. The forefoot region 20, midfoot region 22, and rearfoot region 24 are arranged continuously from the toe toward the heel. The bottom surface of the sole 14 has a shape with excellent design properties, which includes unevenness overall with no or few flat areas.

Figure 4:
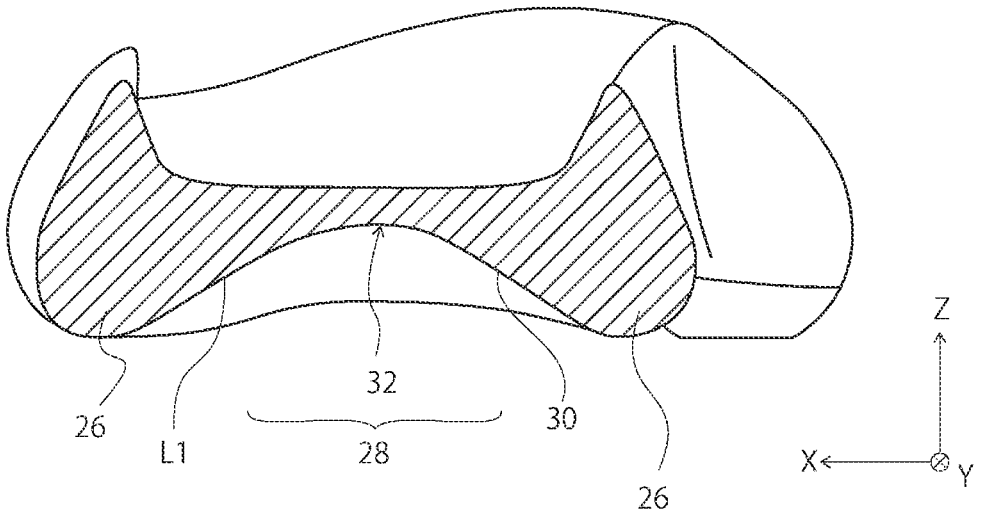
FIG. 4 is a sectional view taken along line A-A in FIG. 3.
Figure 7:
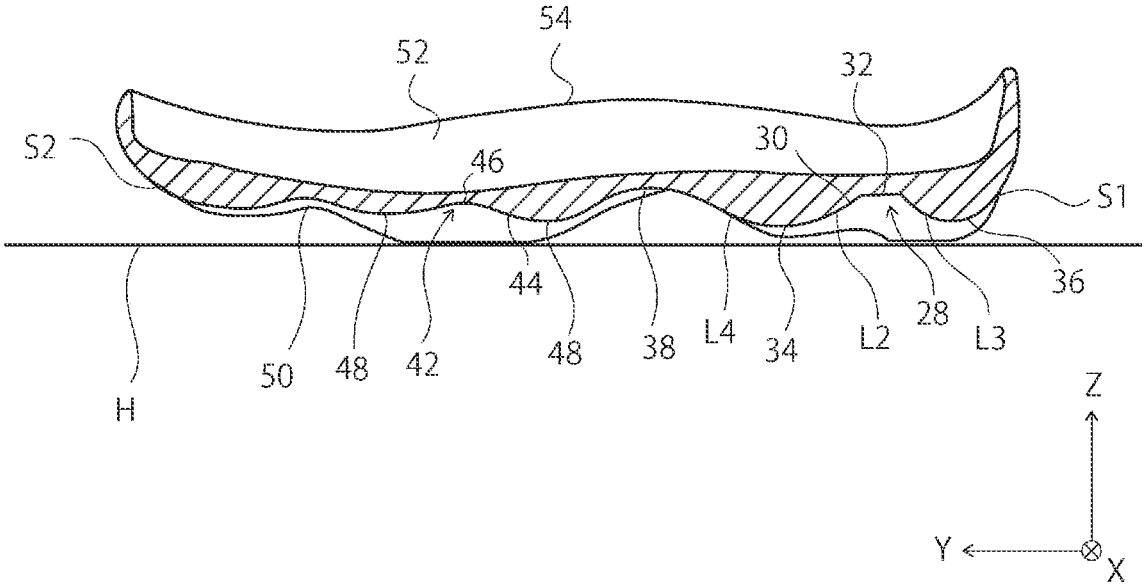
FIG. 7 is a sectional view taken along line D-D in FIG. 3.

As illustrated in FIGS. 3, 4, and 7, in the rearfoot region 24, a pair of ridges (hereinafter, referred to as "rearfoot ridges") 26 extending along the Y-axis are formed and arranged on both sides in a width direction, and a rearfoot-side concave-shaped portion 28 is formed between the pair of rearfoot ridges 26. The pair of rearfoot ridges 26 and rearfoot-side concave-shaped portion 28 are aligned in a width direction.

The rearfoot-side concave-shaped portion 28 is a space having a crater shape recessed upward or a truncated conical shape. The rearfoot-side concave-shaped portion 28 is formed by an inclined surface 30, which is inclined, and a vertex region 32, which is substantially flat. The vertex region 32 has a circular shape and is positioned at a position corresponding to the center of the heel of the wearer. The vertex region 32 is disposed at the highest position (on the +Z side) within the rearfoot region 24. In other words, within the rearfoot region 24, the bottom surface of the sole 14 is not located higher than the vertex region 32. This means that, within the rearfoot region 24, the thickness of the sole 14 is thinnest in the vertex region 32. The inclined surface 30 surrounds the entire circumference of the vertex region 32. The height of the inclined surface 30 gradually increases toward the vertex region 32. In other words, within the rearfoot region 24, the bottom surface of the sole 14 has a shape rising toward the vertex region 32 from all directions, including the longitudinal directions and width directions. The rearfoot-side concave-shaped portion 28 can also be considered to have a dome shape on the A-A and D-D sections. By employing such a shape, when the weight or the wearer is applied to the center of the heel in the vertex region 32, the dome shape collapses slightly. This causes the center of gravity of the wearer to be more easily focused on the vertex region 32, so that the COP of the wearer overlaps with the vertex region 32. Accordingly, the wearer can stably maintain a standing posture.

The rearfoot ridges 26 are arranged at both ends in a width direction of the rearfoot region 24 and extend along edges of the rearfoot region 24. Each rearfoot ridge 26 has a shape that forms a downward convex with respect to the rearfoot-side concave-shaped portion 28. Conversely, it can also be said that the rearfoot-side concave-shaped portion 28 has a shape that forms an upward convex with respect to the rearfoot ridges 26. The vertex surface (the end surface on the −Z side) of each rearfoot ridge 26 is a surface that contacts, when the shoe 10 is placed on a virtual plane H with no load thereon, the virtual plane in the rearfoot region 24. The inside, in a width direction of each rearfoot ridge 26, is defined by the inclined surface 30 of the rearfoot-side concave-shaped portion 28. In other words, the rearfoot ridges 26 and the rearfoot-side concave-shaped portion 28 are continuous. In the A-A section, the bottom surface of the shoe 10 has an inflection point and draws a differentiable curve L1.

On the toe side of the rearfoot-side concave-shaped portion 28, a boundary ridge 34 (corresponding to a "first ridge") is formed to extend along the X-axis. The boundary ridge 34 is formed at the boundary between the midfoot region 22 and the rearfoot region 24 and extends in a width direction across the bottom surface of the sole 14. The boundary ridge 34 has a shape that forms a downward convex with respect to the rearfoot-side concave-shaped portion 28. Conversely, it can also be said that the rearfoot-side concave-shaped portion 28 has a shape that forms an upward convex with respect to the boundary ridge 34. The ridge height of the boundary ridge 34 is lower than that of the rearfoot ridges 26, and the vertex of the boundary ridge 34 does not contact the virtual plane H in a no-load state. Alternatively, the boundary ridge 34 can be designed to contact the virtual plane H. The heel side of the boundary ridge 34 is defined by the inclined surface 30 of the rearfoot-side concave-shaped portion 28. In other words, the boundary ridge 34 and the rearfoot-side concave-shaped portion 28 are continuous. On the heel side of the boundary ridge 34 on the D-D section, the bottom surface of the shoe 10 has an inflection point and draws a differentiable curve L2.

On the heel side of the rearfoot-side concave-shaped portion 28, a rear end ridge 36 is formed to extend along the X-axis. The rear end ridge 36 extends in a width direction such as to connect the heel-side ends of the rearfoot ridges 26 in the width direction. The rear end ridge 36 has a downwardly convex shape with respect to the rearfoot-side concave-shaped portion 28. Conversely, it can also be said that the rearfoot-side concave-shaped portion 28 has an upwardly convex shape with respect to the rear end ridge 36. The ridge height of the rear end ridge 36 is lower than that of the rearfoot ridges 26, and the vertex of the rear end ridge 36 does not contact the virtual plane H in a no-load state. Alternatively, the rear end ridge 36 can be designed to contact the virtual plane H. The toe side of the rear end ridge 36 is defined by the inclined surface 30 of the rearfoot-side concave-shaped portion 28. In other words, the rear end ridge 36 and the rearfoot-side concave-shaped portion 28 are continuous. On the toe side of the rear end ridge 36 on the D-D section, the bottom surface of the shoe 10 has an inflection point and draws a differentiable curve L3. A heel-side surface S1 of the rear end ridge 36 has a curved shape that is downwardly convex.

The pair of rearfoot ridges 26, the boundary ridge 34, and the rear end ridge 36 form, in cooperation, a single ridge (corresponding to a fourth ridge) that surrounds the entire circumference of the rearfoot-side concave-shaped portion 28. Thus, by surrounding the entire circumference of the rearfoot-side concave-shaped portion 28, the wearer's center of gravity is focused on the vertex region 32 more easily from every direction.

As illustrated in FIGS. 3, 5, and 7, the midfoot region 22 has an upwardly recessed shape in the B-B and D-D sections. Around the center in a longitudinal direction and a width direction in the midfoot region 22, a thinner portion 38, where the thickness of the sole 14 is thinner, is formed. The heel side of the thinner portion 38 is defined by the toe-side inclination of the boundary ridge 34. In other words, the bottom surfaces of the boundary ridge 34 and the thinner portion 38 draw a continuous curve L4 in the D-D section.

As illustrated in FIGS. 3, 6, and 7, in the midfoot region 22, a pair of midfoot ridges 40 are formed closer to the toe than the thinner portion 38. The pair of midfoot ridges 40 are arranged at both ends in a width direction of the midfoot region 22 and extend in a Y-axis direction along edges of the midfoot region 22. Between the midfoot ridges 40, a midfoot-side concave-shaped portion 42 is formed.

The midfoot-side concave-shaped portion 42 is a space having an upwardly recessed crater shape or a truncated conical shape. The midfoot-side concave-shaped portion 42 is formed by an inclined surface 44, which is inclined, and a vertex region 46, which is substantially flat. On the toe side and the heel side of the midfoot-side concave-shaped portion 42, a pair of intermediate ridges 48 are formed. Therefore, the entire circumference of the midfoot-side concave-shaped portion 42 is surrounded by the pair of midfoot ridges 40 and the pair of intermediate ridges 48.

Each of the pair of the midfoot ridges 40 (corresponding to a second ridge and a third ridge) has a downwardly convex shape with respect to the midfoot-side concave-shaped portion 42. Conversely, it can also be said that the midfoot-side concave-shaped portion 42 has an upwardly convex shape with respect to the midfoot ridges 40. The vertex surface (the end surface on the −Z side) of each midfoot ridge 40 is the only surface in the midfoot region 22 that contacts, when the shoe 10 is placed on a virtual plane with no load thereon, the virtual plane H. The inside in a width direction of each midfoot ridge 40 is defined by the inclined surface 44 of the midfoot-side concave-shaped portion 42. In other words, the midfoot ridges 40 and the midfoot-side concave-shaped portion 42 are continuous. In the C-C section, the bottom surface of the shoe 10 has an inflection point and draws a differentiable curve L5.

Near the boundary between the forefoot region 20 and the midfoot region 22, a forefoot-side concave-shaped portion 50 extends in a width direction at a position corresponding to the MP joints Ja (see FIG. 1) of the wearer. The forefoot-side concave-shaped portion 50 is a single groove that is upwardly recessed and extends in a width direction across the forefoot region 20. On the sole 14, a surface S2 that is upwardly curved is formed on the toe side of the forefoot-side concave-shaped portion 50 and has a shape such that the bottom surface of the sole 14 is distanced from the virtual plane H.

With reference to FIG. 4 through FIG. 7, on the top surface of the sole 14, a roll-up portion 52 is formed. The roll-up portion 52 surrounds a circumferential edge of the sole 14 and has a shape that extends upwardly from the top surface of the sole 14. The height of the roll-up portion 52 differs depending on the location, and a top end 54 of the roll-up portion 52 has a wavy shape. The height of the roll-up portion 52 is a distance from the top surface of the sole 14 to the top end 54, on the inner side in a width direction of the roll-up portion 52. The roll-up portion 52 is higher in the midfoot region 22 and lower in the forefoot region 20 and the rearfoot region 24. The roll-up portion 52 is highest in a position corresponding to the thinner portion 38 in the midfoot region 22.

It is desirable that the height of the roll-up portion 52 in a position corresponding to the thinner portion 38 is also higher than the height of the roll-up portion 52 in the forefoot region 20 and the rearfoot region 24, besides in the midfoot region 22. However, in a special sole such as the toe-spring structure, the front edge or rear edge of the sole can be oriented extremely upward, so that the roll-up portion can be higher to be conformed thereto. Therefore, when the sole structure of the embodiment is applied to a sole having such a special structure, the height of the roll-up portion 52 can be lower than the height of the roll-up portion around the front edge or around the rear edge of the sole. The "around the front edge of the sole" as used herein means, on a scale on which the front edge of the sole is 0% and the rear edge of the sole is 100%, the range of 0 to 10%. Also, the "around the rear edge" means the range of 90 to 100% on the same scale.

Since the sole 14 is thinner in a position corresponding to the thinner portion 38, the rigidity in the position is lower than that in other locations where the sole 14 is thicker. Therefore, by increasing the height of the roll-up portion 52 in the position corresponding to the thinner portion 38 and in areas in front of and in the rear of the position, the rigidity near the thinner portion 38 can be ensured.

Figure 8:
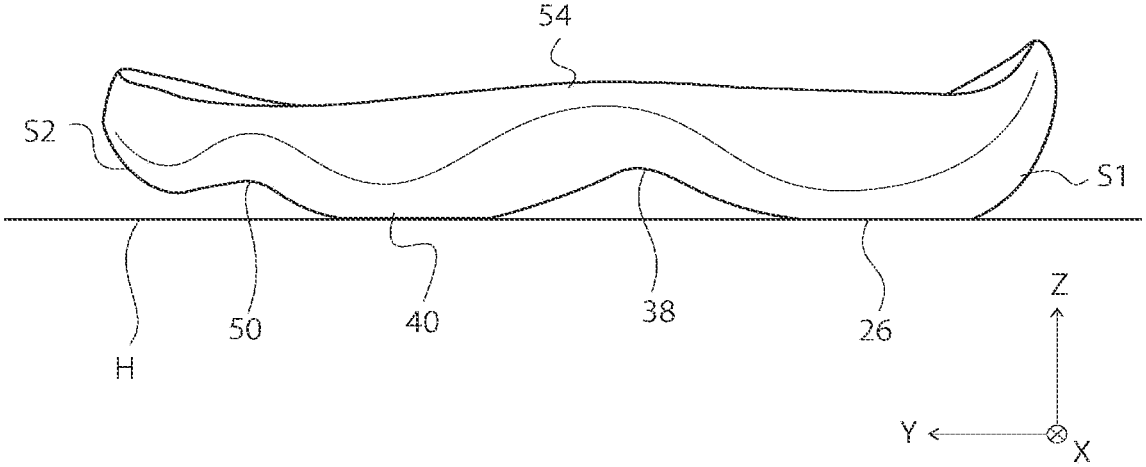
FIG. 8 is a side view on the medial side of the sole.

FIG. 8 is a side view on the medial side of the sole. As illustrated in FIG. 8, when the sole 14 is viewed from the medial side, the bottom surface of the sole 14 has a wavy shape recessed upward at the positions of the surface S2, the forefoot-side concave-shaped portion 50, the thinner portion 38, and the heel-side surface S1. Such a wavy shape is the same also when viewed from the lateral side. Meanwhile, as illustrated in FIG. 7, on the D-D section of the sole 14, the bottom surface of the sole 14 has a wavy shape that is upwardly recessed at the positions of the surface S2, the forefoot-side concave-shaped portion 50, the midfoot-side concave-shaped portion 42, the thinner portion 38, the rearfoot-side concave-shaped portion 28, and the heel-side surface S1. Comparing the two, the number of concaves in the D-D section is greater than that in the side view. Since there is a correlation between the number of upward concave shapes and the number of downward convex shapes, the same can be said about the number of downward convex shapes when the sole 14 is viewed from the medial side and the number of downward convex shapes in the D-D section. The reason for the difference in the number of concaves is that the midfoot-side concave-shaped portion 42 and the rearfoot-side concave-shaped portion 28 are sandwiched respectively between the midfoot ridges 40 and the rearfoot ridges 26 and cannot be visually recognized from a side. Such a sole 14 has excellent design properties.

The functions of the shoe 10 will now be described.

When a wearer takes a standing posture wearing the shoe 10, in the rearfoot region 24, the rearfoot ridges 26 fall inward in the width directions, and the rearfoot-side concave-shaped portion 28 lowers in a downward direction. Accordingly, the COP of the wearer moves toward the vertex region 32. At this time, in the midfoot region 22, the midfoot ridges 40 support the wearer. Thus, the rearfoot side of the wearer is stably supported by the rearfoot-side concave-shaped portion 28, and the midfoot side and the forefoot side are supported by the pair of midfoot ridges 40, so that there are three support points on the bottom surface of the sole 14.

When the wearer performs a running motion, twisting and bending around the Y-axis can occur in the sole 14; however, the roll-up portion 52 around the thinner portion 38 provides resistance to twisting deformation and bending. When the wearer lands in the running motion, since the foot can land at the heel-side surface S1 first, the foot rolls forward.

When the wearer jumps and lands, the crater shape of the rearfoot-side concave-shaped portion 28 softens the impact of the landing.

As described above, according to the embodiment, since the center of gravity is focused on the rearfoot-side concave-shaped portion 28, the wearer can more easily maintain a standing posture. This enables, for example, the wearer to easily perform a motion that requires a stable standing posture, such as singing. The effect of maintaining a standing posture can be further enhanced by the pair of midfoot ridges 40. In addition, with the support configuration similar to the three-point support by the rearfoot-side concave-shaped portion 28 and the midfoot ridges 40, the wearer can more easily maintain the standing posture.

Also, by adjusting the height of the roll-up portion 52 to make the roll-up portion 52 higher around the thinner portion 38, the rigidity of the thinner portion 38 can be ensured. Also, since the heel-side surface S1 of the sole 14 has a curved shape forming a downward convex, with the synergistic effect of the rigidity of the thinner portion 38 and the curved shape, the wearer can more easily shift the center of gravity and, in turn, can more easily perform running motions.

Also, since the rearfoot-side concave-shaped portion 28 is formed into a crater shape, the rearfoot-side concave-shaped portion 28 also functions as a buffer structure when the wearer jumps and lands on the ground.

Thus, the shoe and the sole structure according to the embodiment are particularly suitable for shoes for entertainers who can perform exercises such as dancing intensely while singing.

The present disclosure is not limited to the aforementioned embodiment, and modifications can be appropriately made to each configuration in the embodiment. Within the scope of the present disclosure, the following modifications can be considered.

Figure 9:
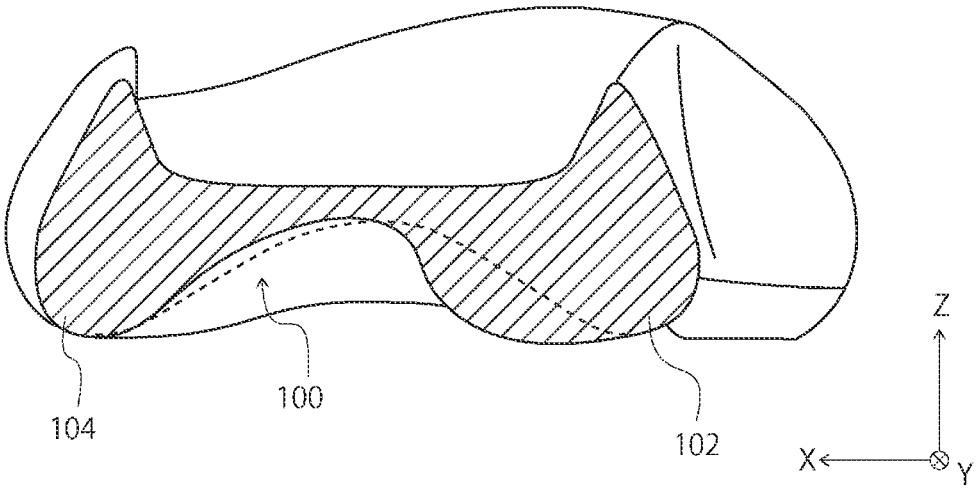
FIG. 9 is a sectional view on the A-A section of a sole according to a modification.

FIG. 9 is a sectional view on the A-A section of a sole according to a modification. In FIG. 9, to clarify, the differences from the structure shown in FIG. 4, the sectional shape of the sole shown in FIG. 4 is indicated by a chain line. As illustrated in FIG. 9, a rearfoot ridge 102 on the medial side of a rearfoot-side concave-shaped portion 100 is wider than the rearfoot ridges 26, and a rearfoot ridge 104 on the lateral side is narrower than the rearfoot ridges 26. The widths of the rearfoot ridges 102 and 104 are adjusted by changing the curvature of the bottom surface. In this structure, by making the rearfoot ridge 102 wider, the rearfoot ridge 102 functions as a structure for preventing overpronation. Also, by making the rearfoot ridge 104 narrower, the rearfoot ridge 104 is deformed more easily and hence functions as a buffer structure on the lateral side where a load is likely to be applied.

Figure 10:
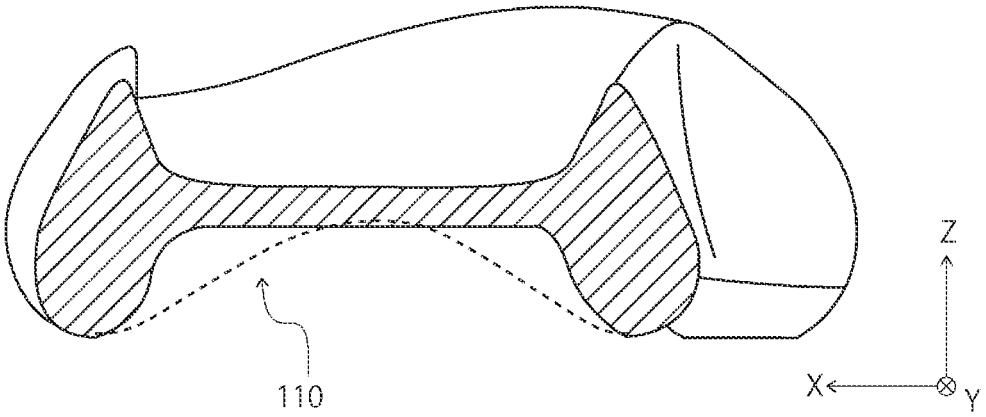
FIG. 10 is a sectional view on the A-A section of a sole according to a modification.
Figure 11:
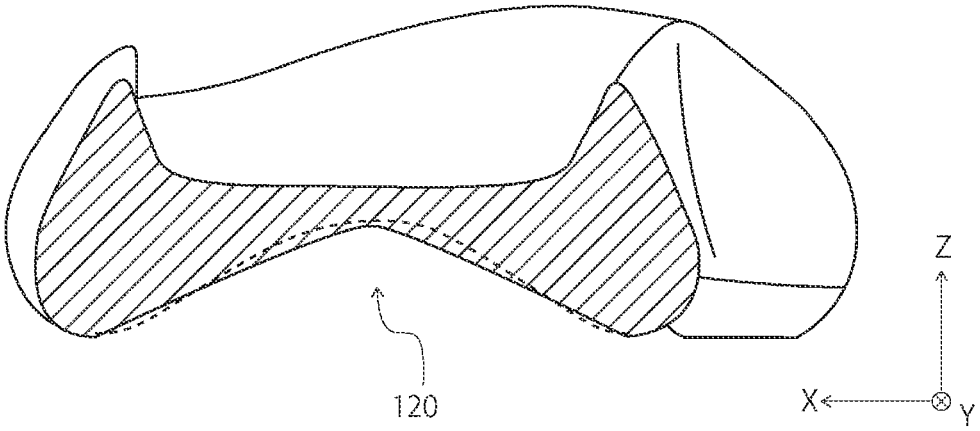
FIG. 11 is a sectional view on the A-A section of a sole according to a modification.

Each of FIGS. 10 and 11 is a sectional view on the A-A section of a sole according to a modification. In FIGS. 10 and 11, to clarify the differences from the structure shown in FIG. 4, the sectional shape of the sole shown in FIG. 4 is indicated by a chain line. As illustrated in FIG. 10, a rearfoot-side concave-shaped portion 110 has an almost trapezoidal shape. In this case, a vertex region 112 has a rectangular shape, and the side surface of the rearfoot-side concave-shaped portion 110 is formed by a curved surface. In other words, in the A-A and D-D sections, the rearfoot-side concave-shaped portion 110 is formed by a combination of straight and curved lines, thereby broadening the vertex region. As illustrated in FIG. 11, a rearfoot-side concave-shaped portion 120 has a triangular shape. In this modification, a vertex region of the rearfoot-side concave-shaped portion 120 is curved, and the side surface is formed by straight lines. Such a structure can also be expected to have effects similar to those of the sole according to the embodiment.

In the aforementioned embodiment, a configuration in which the shoe 10 has no flat surface to enhance the design properties has been described. However, the curves L1-L5 need not necessarily be differentiable curves, and each can have a shape formed by a combination of straight lines and having a vertex.

Embodiments of the present invention are industrially applicable to the field of shoes and shoe sole structures.

The invention claimed is:

1. A sole structure of a sole of a shoe, comprising:

a rearfoot-side concave-shaped portion including a vertex region in a bottom surface of the sole in a rearfoot region, the vertex region including a substantially flat surface in a longitudinal direction and an upward convex curvilinear shape in a width direction at a highest position within the bottom surface of the sole in the rearfoot region and configured to be positioned at a position corresponding to a center of a heel of a wearer such that center of pressure of the wearer overlaps with the center of the heel; and a continuous ridge surrounding the rearfoot-side concave-shaped portion and projecting downwardly to create a crater shape around the rearfoot-side concave-shaped portion, the continuous ridge formed by a pair of rearfoot ridges, a boundary ridge and a rear end ridge, the pair of rearfoot ridges disposed on opposite sides of the vertex region in a width direction, the boundary ridge disposed at a boundary between a midfoot region and the rearfoot region on a front longitudinal side of the vertex region, and the rear end ridge disposed on a rear longitudinal side of the vertex region.

2. The sole structure according to claim 1, wherein the bottom surface of the sole has a shape such that a height of the bottom surface of the sole gradually increases toward the vertex region, from the width direction and the longitudinal direction.

3. The sole structure according to claim 2, wherein the boundary ridge is a first ridge, and the sole includes a thinner portion adjacent to a toe side of the first ridge.

4. The sole structure according to claim 3, wherein the sole includes a roll-up portion along a circumferential edge of the sole, the roll-up portion extending upward, and a height of the roll-up portion near the thinner portion is higher than the height of the roll-up portion in other areas.

5. The sole structure according to claim 2, further comprising a second ridge and a third ridge projecting downwardly and disposed on both sides in the width direction of the bottom surface at the midfoot region of the sole.

6. The sole structure according to claim 5, wherein a concave-shaped portion is formed at a forefoot-side of the sole between the second ridge and the third ridge in the bottom surface of the midfoot region, the concave-shaped portion at the forefoot-side of the sole having a height that gradually increases from the midfoot region towards the forefoot-side in the longitudinal direction.

7. The sole structure according to claim 1, wherein the boundary ridge is a first ridge, and the sole includes a thinner portion adjacent to a toe side of the first ridge.

8. The sole structure according to claim 1, further comprising a second ridge and a third ridge projecting downwardly and disposed on both sides in the width direction of the bottom surface at the midfoot region of the sole.

9. The sole structure according to claim 8, wherein a concave-shaped portion is formed at a forefoot-side of the sole between the second ridge and the third ridge in the bottom surface of the midfoot region, the concave-shaped portion at the forefoot-side of the sole having a height that gradually increases from the midfoot region towards the forefoot-side in the longitudinal direction.

10. The sole structure according to claim 1, wherein the boundary ridge is a first ridge projecting downwardly between the bottom surface at the rearfoot region and the bottom surface at the midfoot region of the sole, the sole structure further comprising a second ridge and a third ridge projecting downwardly on both sides in the width direction of the bottom surface of a forefoot region of the sole;

a plurality of convex shapes including the second ridge and the third ridge disposed along a medial side end or a lateral side end from a vicinity of a toe to a vicinity of a heel; and a plurality of convex shapes including the first ridge formed from the vicinity of the toe to the vicinity of the heel in a position along a middle in the width direction of the bottom surface of the sole, a number of the plurality of convex shapes disposed in the position along the middle in the width direction of the bottom surface of the sole is larger than a number of convex shapes disposed on the medial side end or the lateral side end of the bottom surface of the sole.

11. A shoe, comprising:

an upper configured to accommodate a foot of a wearer; and the sole including the sole structure according to claim 1, the upper attached to the sole.

12. The sole structure according to claim 1, wherein the pair of rearfoot ridges contact a ground surface in a no-load state, and the boundary ridge does not contact the ground surface in the no-load state.

13. The sole structure according to claim 1, wherein the pair of rearfoot ridges contact a ground surface in a no-load state, and the rear end ridge does not contact the ground surface in the no-load state.

14. A sole structure of a sole of a shoe, comprising:

a rearfoot-side concave-shaped portion including a vertex region in a bottom surface of the sole in a rearfoot region, the vertex region including a substantially flat surface in a longitudinal direction and an upward convex curvilinear shape in a width direction at a highest position within the bottom surface of the sole in the rearfoot region and configured to be positioned at a position corresponding to a center of a heel of a wearer such that center of pressure of the wearer overlaps with the center of the heel; and a first ridge projecting downwardly and disposed between the bottom surface at the rearfoot region and the bottom surface at a midfoot region of the sole, the sole including a thinner portion adjacent to a toe side of the first ridge, the sole including a roll-up portion along a circumferential edge of the sole, the roll-up portion extending upward, and a height of the roll-up portion near the thinner portion is being higher than the height of the roll-up portion in other areas.

15. A sole structure of a sole of a shoe, comprising:

a rearfoot-side concave-shaped portion including a vertex region disposed in a bottom surface at a rearfoot region of the sole; and a fourth ridge including a pair of rearfoot ridges, a boundary ridge and a rear end ridge that form a continuous ridge within the rearfoot region that is disposed to surround an entire circumference of the rearfoot-side concave-shaped portion and projecting downwardly to create a crater shape around the rearfoot-side concave-shaped portion, the pair of rearfoot ridges disposed on opposite sides of the vertex region in a width direction and contacting a ground surface in a no-load state, the boundary ridge formed at a boundary between a midfoot region and the rearfoot region on a front longitudinal side of the vertex region, the rear end ridge disposed on a rear longitudinal side of the vertex region, and at least one of the boundary ridge or the rear end ridge does not contact the ground surface in the no-load state, the vertex region including an upward convex curvilinear shape at a highest position within the bottom surface of the sole in the bottom surface at the rearfoot region and configured to be positioned at a position corresponding to a center of a heel of a wearer.

16. The sole structure according to claim 15, wherein the fourth ridge and the rearfoot-side concave-shaped portion are continuous such that each of a base of a cross section in the width direction that passes through the position corresponding to the center of the heel and a base of a cross section in the longitudinal direction that passes through the position corresponding to the center of the heel forms a curve that includes an inflection point.

17. The sole structure according to claim 16, wherein a heel-side surface of the fourth ridge has a curved shape.

18. A shoe, comprising:

an upper configured to accommodate a foot of a wearer; and the sole including the sole structure according to claim 15, the upper attached to the sole.

19. The sole structure according to claim 15, wherein the upward convex curvilinear shape is in the width direction of the shoe.

20. The sole structure according to claim 19, wherein the vertex region includes a substantially flat surface in the longitudinal direction.

* * * * *